United States Patent [19]

Glander et al.

[11] 4,008,113

[45] Feb. 15, 1977

[54] HIGH VOLTAGE CABLE

[75] Inventors: Fritz Glander, Isernhagen; Hermann Uwe Voigt, Langenhagen, Germany

[73] Assignee: Kabel-und Metallwerke Gutehoffnungshutte Aktiengesellschaft, Hannover, Germany

[22] Filed: May 20, 1975

[21] Appl. No.: 579,193

[30] Foreign Application Priority Data

May 11, 1974 Germany ..... 2422914

[52] U.S. Cl. ..... 156/52; 196/244; 174/110 S; 427/118

[51] Int. Cl.[2] ..... H01B 3/10

[58] Field of Search ..... 427/117, 118; 260/824 R, 827, 42.39, 37 SB; 174/110 S, 120 SC, 102 SC; 156/244, 51, 52, 56; 204/159.13

[56] References Cited

UNITED STATES PATENTS

| | | | |
|---|---|---|---|
| 3,047,448 | 1/1962 | Feller et al. | 174/110 S X |
| 3,541,228 | 11/1970 | Lombardi | 427/118 X |
| 3,725,230 | 4/1973 | Bahder et al. | 174/120 SC X |

*Primary Examiner*—David A. Simmens
*Attorney, Agent, or Firm*—Ralf H. Siegemund

[57] ABSTRACT

A stranded filament bundle is coated with a cross-linking plastic that contains carbon black followed by enveloping in a plastic that cross-links in the presence of moisture. The inner coating will cross-link either when the outer layer cross-links by water treatment; or by conduction of heat in the extruder for the outer layer; or by microwave heating.

5 Claims, 2 Drawing Figures

HIGH VOLTAGE CABLE

BACKGROUND OF THE INVENTION

The present invention relates to an electric cable, particularly of the high or even very high voltage variety having an insulative envelope made of a cross-linking material.

The German printed patent application DAS 1,794,028 discloses a method for cross-linking organic polymers by grafting of alcoxy-silane compounds on a polymer and curing the resulting graft polymer in the presence of moisture to obtain the cross-linking. For example, polyethylene is mixed with an alcoxy compound (silane) having the structure and R Si $Y_3$ under conditions, in which free radicals of the polymerisate is formed. R represents a vinyl group or an alpha-methacryl-oxypropyl group and 1/3 is an alcoxy group with less than six carbon atoms. During or after mixing a silanol condensation catalyst can be added. Other additives may include organic peroxides which furnish free radicals. The material can be mechanically worked, for example, in an extruder, in which the mixture is homogenized, while the grafting takes place as the result of the heating process that takes place in the extrusion press.

The mixtures in accordance with the aforementioned procedure cross-link in the presence of moisture. Thus, granulation and storage of the grafted (but not yet cross-linked) material presents a significant problem and cross-linking may well begin prematurely which renders subsequent working difficult or even impossible.

It was found that the problem posed by premature cross-linking was compounded when the grafted material is to be used to make an electrically conductive composition by adding, for example, soot, i.e. carbon black, to the polymer. Such carbon black is very hygroscopic and inherently contains significant amounts of moisture. Even if subjected to drying all moisture cannot be removed from carbon black. It follows that a conductive mixture which cross-links in the presence of moisture (e.g. siloxan bridges or links) are hardly usable for the making of a cable, because the time period between completing the mixture and completing a cable jacket to the extent that it can cross-link is too long, so that premature cross-linking is more or less inevitable.

Electrical cable and conductors particularly when used for high or even very high voltages are usually provided with a surface finishing envelope or coating, which smoothes the surface of the conductor or envelopes a bundle of stranded conductor filaments in a thin jacket with smooth, round overall surface. Any roughness would increase local field strength. Such surface finishing coating is particularly advantageous, when made of cross-linking material. In connection therewith it is customary to cross-link this surface finish coating as well as the insulation envelope around the coating in that the layers are extruded and are passed through a heating station, because cross-linking is often carried out at elevated temperatures.

DESCRIPTION OF THE INVENTION

It is an object of the present invention to improve the method of making electrical cable, wherein conductors or bundles of conductor filaments are provided with an enveloping, conductive, surface-finishing coating and an outer insulation layer in accordance with a new and improved method.

In accordance with the preferred embodiment of the invention, it is suggested to provide an electrically conductive surface finishing coating which cross-links without application of heat while the outer insulation is provided from grafted polymer, which cross-links in the presence of moisture. It follows that neither the coating nor the outer layer or jacket requires the development of external thermal energy. The inner coating can be made to cross-link in the presence of moisture, in which case any moisture containing additive is added immediately prior to coating. If the surface finishing coating requires heat for cross-linking, that heat is either developed through uhf application and internal electrical currents resulting from absorption of that radiation heat that layer; or by conduction of heat from the outer layer when being extruded (and heated thereby for grafting) onto the surface finishing coating. The resulting cable is duly insulated, but the inner layer cross-links without application of external heat. As a consequence, one can use such a cable for the conduction of high voltages, e.g. in excess of 1 kilovolt.

The base material for the inner layer or coating may include a thermoplastic or elastomeric substance that cross-links in the presence of moisture. If hygroscopic carbon black is used as additive, the layer is rendered electrically conductive, but premature cross-linking is still avoided if that carbon black is added while the particular layer coating is being extruded around the cable core. The carbon black may be added as a batch, and one actually may use a concentration thereof to obtain a final content of up to 40 parts by weight of carbon black, depending on the desired electrical conductivity for this inner layer.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a cable core 1 constructed from plural, stranded filaments constituting a stranded conductor assembly. The bundle of filaments is enveloped in a conductive coating 2 for surface finishing the bundle as a whole, so that the surface of the conductive core as such is sufficiently smooth for avoiding the formation of local field peaks.

This coating 2 is made of a cross-linked polymer to which carbon black has been added to provide for the necessary electrical conductivity. The cable has an outer insulation 3, which is an organic polymerisate to which an alcoxy silane compound was grafted and which cross-linked subsequently in the presence of moisture.

Figure 1:
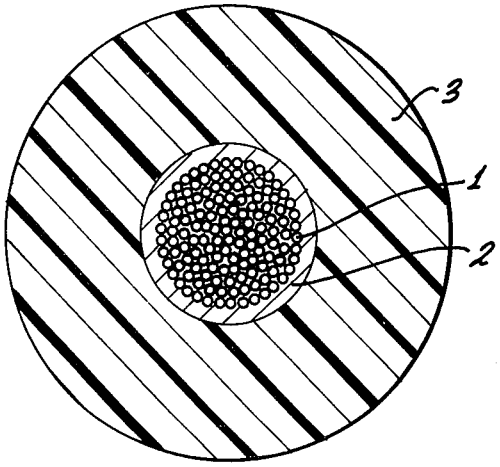
FIG. 1 is a cross-section through a cable constructed in accordance with the preferred embodiment.
Figure 2:
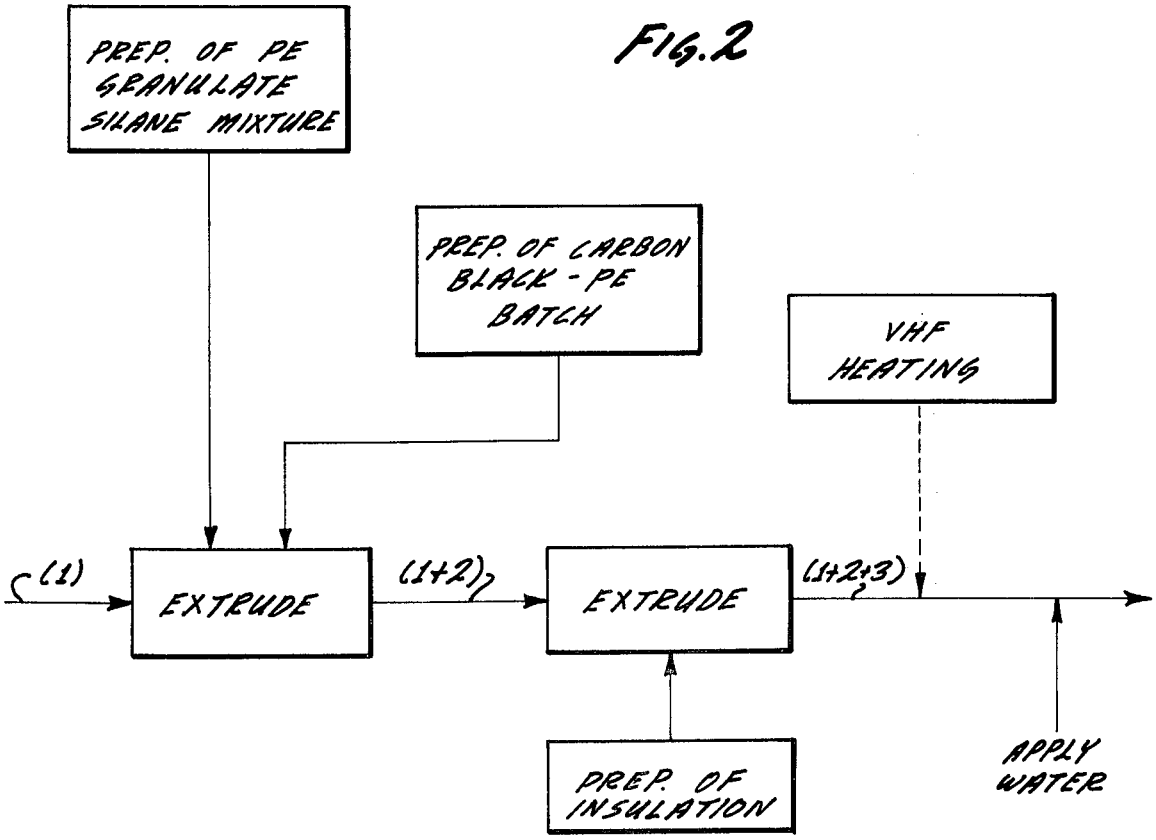
FIG. 2 is a process diagram.

The conductor is provided with the several envelopes as follows (see FIG. 2). One begins with the preparation of a batch in which fluidizable granulate or powder of a thermoplastic material (e.g. Polyethylene) is mixed with a cross-linking compound, such as a silane compound and other additives (a peroxide, an activator, possibly a catalyst) and agitated so that its temperature is raised but remains below the crystalite melting point, e.g. between 60° to 100° C or thereabouts. The cross-linking silane will diffuse into the particles of the powder. This procedure is, for example, described in patent application by one of us, Ser. No. 557,108, filed Mar. 10, 1975. The silane and other additives are, therefore, homogeneously distributed in the polymer.

Separately, a polymer carbon black batch is prepared at a ratio so that the final mixture will have about 40 % carbon black or less. The two batches are next mixed in that they are both fed to the extruder concurrently and at the desired ratio, and the coating 2 is then extruded onto and around the conductor 1. The two batches are intimately mixed in the extrusion press. It can thus be seen that the carbon black (containing some water due to the fact that the carbon black is hygroscopic) is mixed with the grafted polymer in the extruder only, and immediately prior to application to the core 1 as a coating. Very little cross-linking can be expected prior to the formation of that coating and any curing, e.g. for thermosetting takes place right when the plastic-carbon black mixture has formed a surface finishing coating around the filament bundle.

The carbon black used here should be of the type so that as little as possible is needed to obtain the desired electrical conductivity. A carbon black suitable and preferred for practicing the invention is, for example, known and traded under the designation Ketjenblack EC. It was found that a content of 10 to 15 % of such carbon black in the final mixture and coating is already sufficient to provide for the necessary electrical conductivity. For example, the electrical resistivity of a mixture with only 10 parts by weight of that type of carbon black drops already below 100 ohmcentimeters. The moisture carried by that carbon black is accordingly low, so that premature cross-linking occurs to a relatively small extent only.

Another type of carbon black which was found to be quite suitable, because it carries little moisture (so that premature cross-linking is low) is of the variety which has been classified to have a median particle size of 70 to 100 m$\mu$, preferably 95 m$\mu$ and an average surface of 15 to 30 square meters per gram, preferably 20 to 25 $m^2/g$ per BET. This powder is rather coarse, which is the reason for a comparatively low moisture content. The conductivity in the sense of radiation shielding is sufficiently high and that coating can be welded to other thermoplastic material forming therewith a satisfactory bond.

In furtherance of the invention, the batch should include a water bonding or absorbing additive so that the moisture content of the carbon black is effectively neutralized. The requirement here is that the particular additive will bond and keep the water even at the elevated temperatures as occurring in the extruder, whereby particularly that bond must be stronger than the bonding of water in the carbon black.

A particularly suitable additive here is calcium oxide, for example, of the type traded under the designation Rhenosorb; however, other water absorbing substances can be used and added directly or as a coating on the powder particles or it can be presented in batch form. It has to be observed, however, that the amount of water absorbing substance must be accurately stoichiometrically determined because any excessive binding of water would deplete the water content necessary for cross-linking and whenever developed.

Following the extrusion of coating 2, an insulating plastic is extruded around the conductive cable coating 2 to form insulation jacket 3. This jacket 3 may, for example, be comprised or a polyethylene with a silane compound added for grafting. The preparation may be the same as outlined above and in the above-mentioned patent application. Specifically, the material for layer 3 may be similar to that for coating 2 except for the carbon black and other additives directly attributable to the presence of carbon black.

As outlined above, both layers are of the type which cross-link in the presence of moisture. Specifically, the inner coating will cross-link to some extent on account of the water content in the carbon black, but that will take place predominantly after the coating 2 has been applied. Moreover, a subsequent water treatment in one form or another will affect the outer layer 3 as well as the inner layer 2.

If the inner coating 2 requires thermal energy for obtaining cross-linking, for example, by thermal decomposing a peroxide, one proceeds as follows: The coating may have resulted from preparing a batch in a different way, which is then mixed with carbon black and extruded. The batch may be a powder of plastic, such as polyethylene that will cross-link on application of heat. The extrusion process may have been carried out here under observation of temperatures below the cross-linking temperature. Cross-linking may now be obtained in one of the following two ways:

Following the extrusion of outer insulation 3 the cable may pass through a microwave heating station to apply Uhf frequency thereto. The carbon black containing layer 2 absorbs such radiation very efficiently and heats it. The layer may include a peroxide which is thermally decomposed in that manner, so that the polymer cross-links without having to use a steam heating station. The outer layer 3 will cross-link, for example, through exposure to moisture as explained by way of example in the above-identified application.

Another way of cross-linking the inner layer 2 may consist of merely using the extrusion heat when the second layer (3) is applied. The heat travelling from the newly deposited layer material 3 into layer 2 may well suffice to provide the heat necessary for cross-linking. The outer layer 3 may still be cross-linked by internal and/or external exposure to water.

The extrusion process for the outer layer will particularly suffice for the development of adequate cross-links in the inner layer, when the extrusion temperature for that outer layer is high, e.g. above 200° C. Such a temperature is always needed when grafting is carried out concurrently with the extrusion of that outer layer.

It can readily be seen that the two ways can be used together, if for one reason or another the heat of the extrusion of the outer layer is not sufficient to complete the cross-linking in the inner layer to the desired degree.

It can readily be seen that the additional application of heat from the outside is not needed in either of these cases. Whenever the inner coating is made of a plastic that cross-links in the presence of moisture the process outlined above still permits the adding of hygroscopic carbon black without significant premature cross-linking that would interfere with the heating process. In the case of a different material for the inner coating, one uses either "waste" thermal energy from the extrusion of the outer insulation layer, or internal, high frequency heating is used to raise the temperature of the coating above cross-linking temperature. Neither case requires an external heating source in the strict meaning of the word.

We claim:

1. Method of making a cable, comprising the steps of:
providing a cross-linking, not yet cross-linked, electrically conductive, first layer around a conductor or conductor assembly as overall surface finishing and conductive coating, the first layer requiring thermal energy for cross-linking;
providing a cross-linking, not yet cross-linked graft-polymeric second layer onto said first layer;
causing said first layer to cross-link through thermal energy conducted from the second to the first layer but without conduction of thermal energy into the second layer from the outside of said first and second layer; and
causing the second layer to cross-link in the presence of moisture.

2. Method of making a cable, comprising the steps of:
providing a cross-linking, electrically conductive, first layer around a conductor or conductor assembly as overall surface finishing and conductive coating;
hot extruding a cross-linking, graft-polymeric second layer onto said first layer;
causing the second layer to cross-link in the presence of moisture; and
causing the first layer to cross-link through influx of thermal energy from the second layer without application of heat from the outside of the second heat as provided but extensively originating as heat content of the second layer as applied.

3. Method of making a cable, comprising the steps of
providing a cross-linking, electrically conductive, first layer around a conductor or conductor assembly as overall surface finishing and conductive coating;
providing a cross-linking, graft-polymeric second layer onto said first not yet cross-linked layer, whereby the second layer is applied under a temperature in excess of cross-linking temperature for the material of the first layer, so that the first layer cross-links during the providing of the second layer; and
causing the second layer to cross-link in the presence of moisture.

4. Method of making a cable, comprising the steps of
providing a mixture of an elastomeric or plastic material, which cross-links in the presence of moisture;
adding a material to the mixture to render the mixture electrically conductive;
providing a first layer of the mixture with added material around a conductor;
providing a second layer of a plastic or elastomeric material around the first layer which cross-links in the presence of moisture; and
providing moisture to the layers to obtain cross-linking.

5. Method as in claim 4, wherein the electrically conductive material is added immediately preceding the step of providing the first layer.

* * * * *